US007288050B2

(12) United States Patent
Murphy

(10) Patent No.: US 7,288,050 B2
(45) Date of Patent: Oct. 30, 2007

(54) MAGNETICALLY RESISTIVE EXERCISE DEVICE FOR REHABILITATIVE THERAPY

(76) Inventor: William T. Murphy, 305 W. 31st Ave., Spokane, WA (US) 99203

( * ) Notice: Subject to any disclaimer, the term of this patent is extended or adjusted under 35 U.S.C. 154(b) by 1 day.

(21) Appl. No.: 11/200,902

(22) Filed: Aug. 11, 2005

(65) Prior Publication Data

US 2007/0037671 A1 Feb. 15, 2007

(51) Int. Cl.
*A63B 21/00* (2006.01)
*A63B 21/02* (2006.01)
*A63F 3/00* (2006.01)

(52) U.S. Cl. ..... 482/92; 482/114; 482/148; 273/239

(58) Field of Classification Search ..... 482/148, 482/903, 92, 114; 273/239
See application file for complete search history.

(56) References Cited

U.S. PATENT DOCUMENTS 2,511,774 A * 6/1950 Goldsmith ..... 273/239
3,194,561 A * 7/1965 Schumann ..... 273/309
3,761,092 A * 9/1973 Shieff ..... 273/239
4,005,866 A * 2/1977 Marcil ..... 273/239
5,413,352 A * 5/1995 Persidsky et al. ..... 273/287
7,056,266 B2 * 6/2006 Sudeith ..... 482/37
2003/0148853 A1 * 8/2003 Alessandri et al. ..... 482/5
2005/0014612 A1 * 1/2005 Sugiyama et al. ..... 482/79

* cited by examiner

*Primary Examiner*—Stephen R. Crow
*Assistant Examiner*—Allana Lewin
(74) *Attorney, Agent, or Firm*—Keith S. Bergman; William A. Jeckle

(57) ABSTRACT

A magnetically resistive exercise device for rehabilitative therapy provides a body with adjustably inclinable planar work surfaces and a curvilinear work surface all formed of magnetically permeable material. A movable exercise piece supportable by or on a user's hand or foot carries at least one magnet for user generated motion over the work surfaces. Therapeutic rehabilitation is provided by frictional resistance to movement of the exercise piece on work surface. The frictional resistance may be adjustably varied by number and strength of magnets carried in the exercise piece and by surface coverings of differing frictional characteristics on the exercise piece, the work surface or both.

5 Claims, 4 Drawing Sheets

FIG. 3
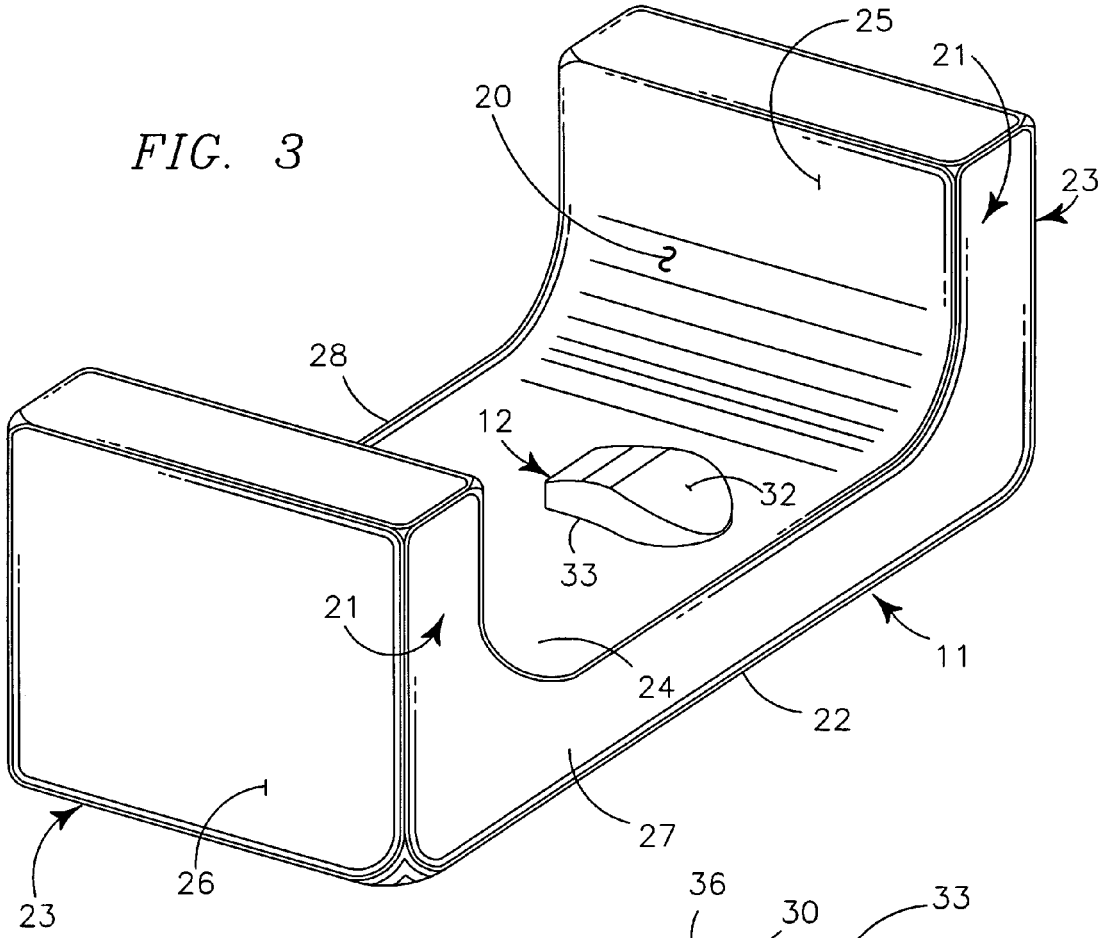
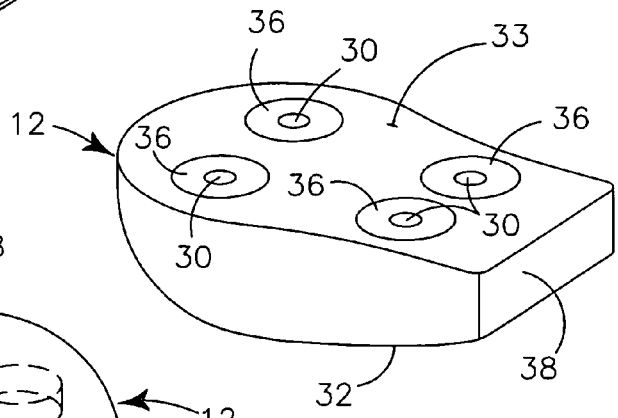
FIG. 4
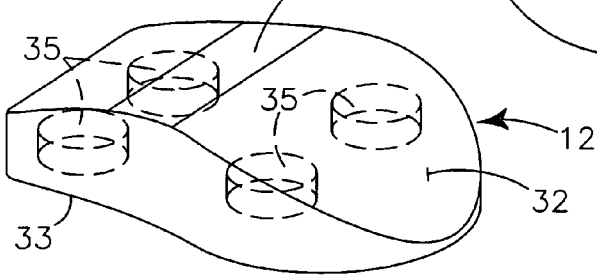
FIG. 5

FIG. 6
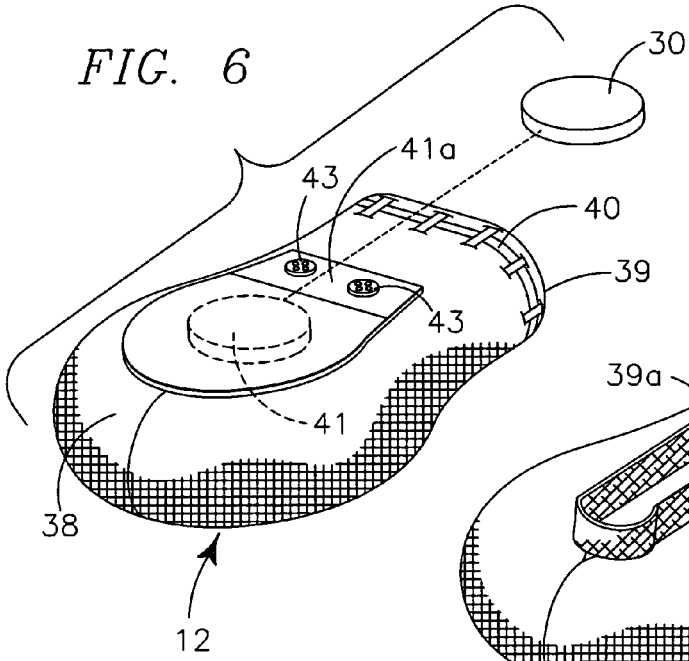
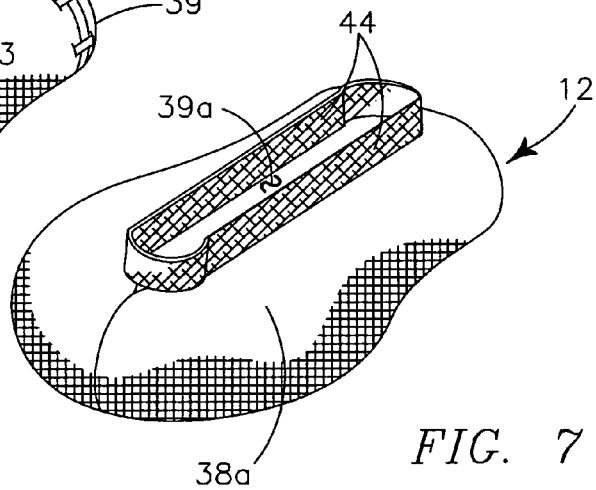
FIG. 7
FIG. 8
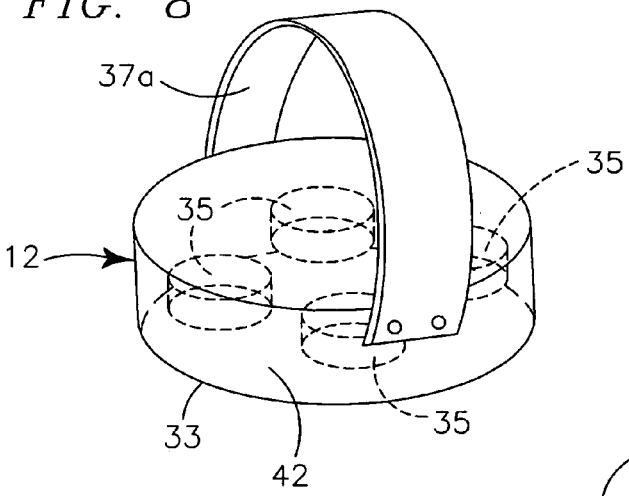
FIG. 9
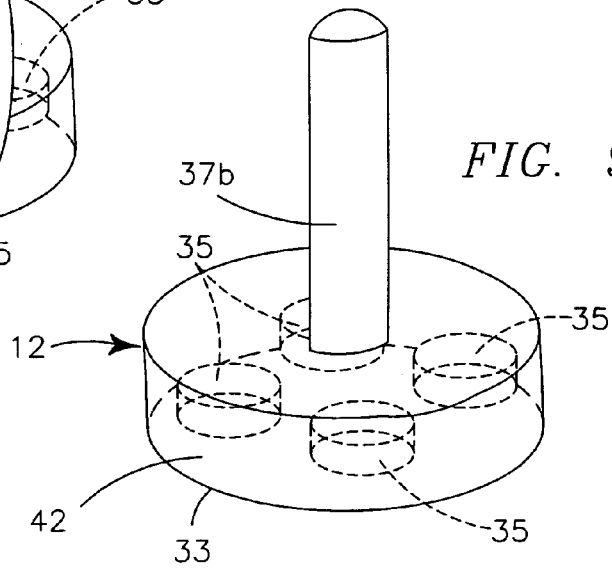

MAGNETICALLY RESISTIVE EXERCISE DEVICE FOR REHABILITATIVE THERAPY

Be it known that I, William T. Murphy, a citizen of the United States and a resident of Spokane County in the State of Washington, whose Post Office address is 305 West 31st Avenue, Spokane, Washington 99203, have invented certain new and useful improvements in MAGNETICALLY RESISTIVE EXERCISE DEVICE FOR REHABILITATIVE THERAPY of which the following is a specification and for which I pray for issuance of utility Letters Patent.

BACKGROUND OF THE INVENTION

Related Applications

There are no applications related hereto heretofore filed in this or in any foreign country.

1. Field of Invention

My invention relates generally to therapeutic rehabilitation devices and more specifically to such devices that utilize magnetic force to generate resistance to movement of a patient manipulable magnetic work piece over a magnetically permeable surface for exercise purposes of a human limb.

2. Background and Description of Prior Art

Rehabilitation devices for persons with disabilities to be practically useful must be safe, simple of use and sufficiently customizable so as to retain effectiveness while accommodating the particular physiological limitations of a user.

Physiological rehabilitation for disabled persons is generally patient specific. For persons with severe disabilities, successful physiological rehabilitation frequently requires psychological aid in terms of increasing confidence, emotional well being, and personal sense of satisfaction. An effective rehabilitative device must have potential to provide both physiological and psychological therapy leading to these results.

A myriad of rehabilitation apparatus is available to aid persons with disabilities but much of this apparatus is characterized by similar drawbacks. Many devices are designed for persons with some mobility. Such devices with suspended weights, springs or tensive mechanisms present potential dangers and often insurmountable obstacles to users with minimal mobility, coordination strength or muscular control. Devices utilizing cables, rails and tracks often cannot be customized sufficiently to provide rehabilitation for particular disabilities such as difficulty in using an abduction device to provide adduction or in reducing operative resistance to allow use by a profoundly disabled user. Such drawbacks are especially frustrating to persons with limited muscular control or dexterity and such frustrations may negate the effectiveness of rehabilitative therapy and thereby negate the effectiveness of the rehabilitation device.

My invention provides potential for overcoming various of the drawbacks of the prior art. My invention provides a base having a work surface formed by magnetically permeable material and an exercise piece carrying one or more magnets. As the exercise piece is moved on the work surface the attraction of the magnets to the work surface increases friction between the adjacent surfaces of the work surface and exercise piece to provide resistance to motion in all directions along the work surface without the limitations of cables, tracks, weights, rails or tensive devices and without effect from velocity of the motion.

Varying the number, size and strength of magnets in the exercise piece permits my exercise device to be used for a variety of exercises by persons with differing physiological limitations. My invention further provides a rehabilitative device for disabled persons that is safe for use without assistance, is customizable for therapy designed for particular users, and one that aids in building confidence, self esteem during the psychological rehabilitative process, strength, coordination and dexterity to aid in providing psychological rehabilitation.

My invention does not reside in any one of these features individually, but rather in the synergistic combination of all of its structures which necessarily give rise to its functions as herein specified and claimed.

SUMMARY OF THE INVENTION

My invention generally provides an exercise device with a peripherally defined base having at least one magnetically permeable work surface and an exercise piece carrying at least one magnet and movable on the work surface. The work surface may be a simple planar surface that may be variously orientated relative to the base for particular exercises or may be a continuous curvilinear surface with curvature in two or three dimensions. The magnetically permeable material of the work surface preferably is formed of iron or a ferrous metal composition. The exercise piece has a body, either rigid or flexible, that aids grasping and manipulation by a user. The exercise piece may provide fastening means for maintenance on an appendage of a user without active participation by the user such as a glove, stocking, handle, strap or the like. The exercise piece may carry one or a plurality of magnets of varying sizes, arrays and strengths. The magnets preferably are of the permanent ferro-magnetic type for economy, but may be electromagnets or magnets formed of known rare earth metals.

In providing such a device it is a principal object to provide a rehabilitation device using magnetic attraction between a magnet carried by an exercise piece and a magnetically permeable work surface to generate frictional resistance to motion of the exercise piece on and over the work surface.

It is a further object to provide such a device that is customizable to accommodate particular physiological abilities and needs of a user.

It is a further object to provide such a device that provides magnetically generated continuous and uniform frictional resistance throughout the range of exercise piece motion in any direction along the work surface.

It is a further object to provide such a device that may be safely used without assistance by a person who is immobile.

It is a further object to provide such a device that psychologically aids in building confidence, strength, coordination and dexterity while providing psychological rehabilitation.

It is a still further object to provide such a device that may be positioned on or across a person's lap for arm and upper torso rehabilitation and therapy and on a floor for foot, leg and lower body rehabilitation and therapy.

Other and further objects of my invention will appear from the following specification and accompanying drawings which form a part hereof. In carrying out the objects of my invention, however, it is to be understood that its features are susceptible of change in design and structural arrangement with only preferred and practical embodiments of the best known modes being illustrated in the accompanying drawings and specified as is required.

BRIEF DESCRIPTIONS OF DRAWINGS

In the accompanying drawings which form a part hereof and wherein like numbers refer to similar parts throughout:

FIG. 3 is an isometric bottom, rear and right side view of the channel defined by the bottom of the body showing a first preferred embodiment of the exercise piece on the bottom work surface.

FIG. 4 is an enlarged isometric top, rear and right side view of first preferred embodiment of exercise piece showing plural magnet cavities in the bottom portion in phantom outline.

FIG. 5 is an isometric bottom, front and right side view of the exercise piece of FIG. 4 showing the magnet cavities carrying magnets embedded in cavity filler material.

FIG. 6 is an isometric bottom, front and left side view of a second embodiment of exercise piece having a mitten type configuration and a closable magnet pocket defined therein with the removed magnet shown in phantom outline.

FIG. 7 is an isometric top, front and left side view of a third embodiment of exercise piece having a sock type configuration and a closable opening in the upper surface.

FIG. 8 is an isometric top and left side view of a fourth embodiment of exercise piece with a loop extending over the upper grasping surface and plural magnet cavities shown in phantom outline.

FIG. 9 is an isometric top and left side view of a fifth embodiment of exercise piece having a vertical rod-like handle for grasping and plural magnet cavities shown in phantom outline.

DESCRIPTION OF PREFERRED EMBODIMENT

As used herein, the term "front", its derivatives, and grammatical equivalents refer to that side or portion of my exercise device distal from the user's head when the exercise device is positioned on or across the user's lap or upper legs. The term "rear", its derivatives, and grammatical equivalents refer to that side or portion of the exercise device proximal to the user's head when the exercise device is positioned on or across user's lap or upper legs. The terms "right" and "left" are as determined from the viewpoint of a user with the exercise device positioned on the user's lap or upper legs. The term "magnetic permeability", its semantic, grammatical and rhetorical equivalents describe the nature of material that is attracted by a ferro-magnet, which most commonly is a ferruginous composition or an alloy of combinations of any of iron, nickel or cobalt.

The exercise device generally provides a "U" shaped body 11 having magnetically permeable work surface members 13 and a separated exercise piece 12 movable over the work surfaces 13 by a user to exercise the user's limbs and related muscles of the torso.

Figures 1, 2:
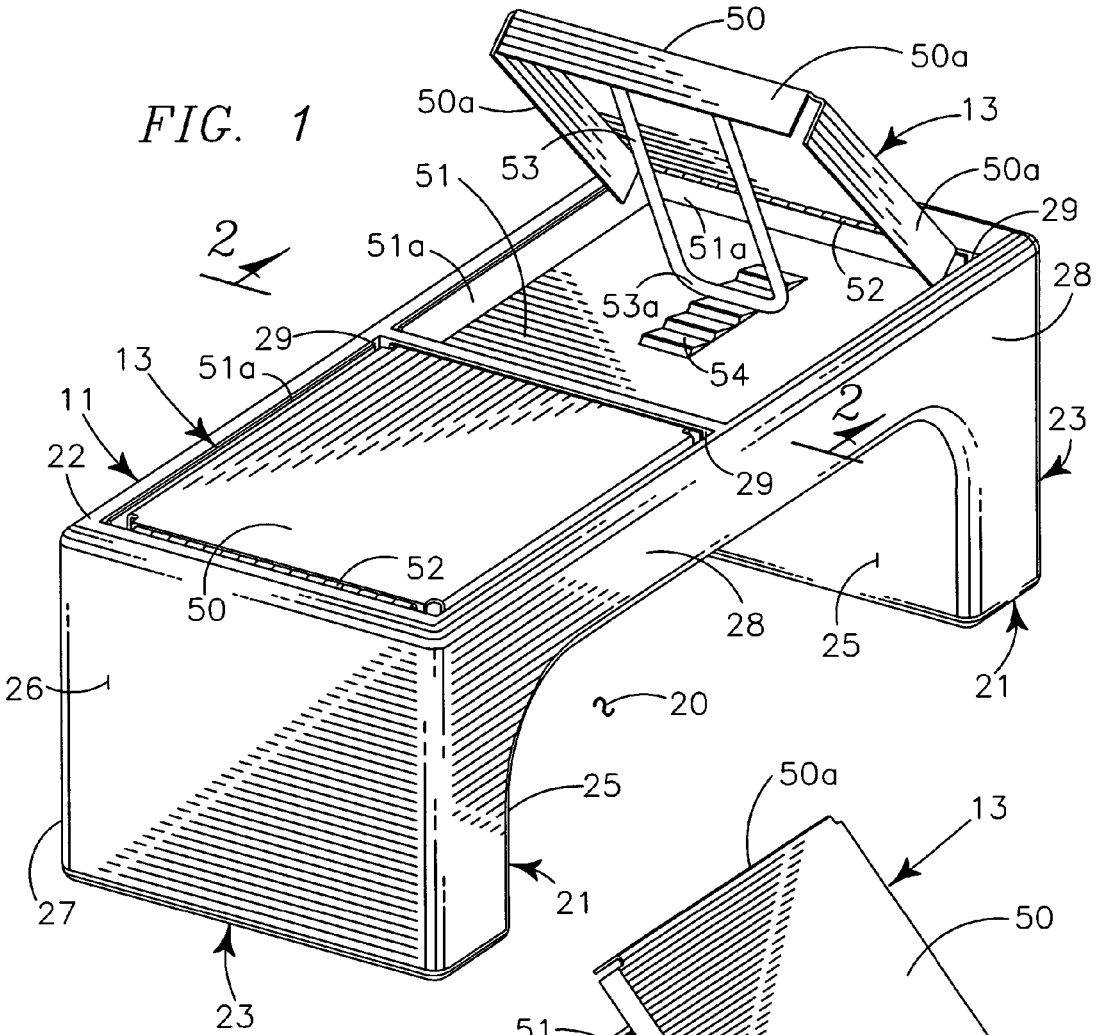
FIG. 1 is an isometric top, front and right side view of the body of my exercise device showing various of its parts, their configuration and relationship.
FIG. 2 is a partial cutaway isometric view of the exercise device of FIG. 1, such as would appear if FIG. 1 were cut on the line 2-2 thereon in the direction indicated by the arrows with the left inclinable work surface element rotated 90° in clockwise direction.
Figure 10:
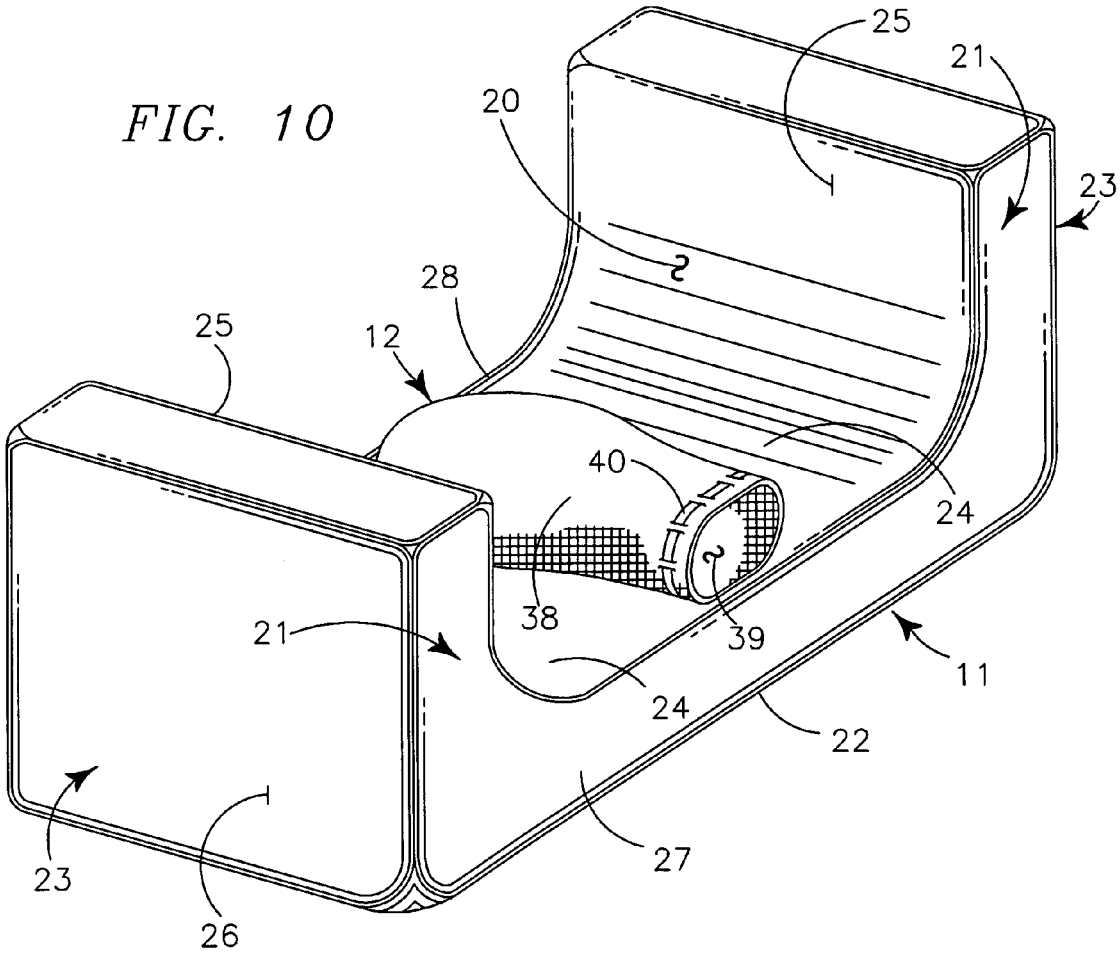
FIG. 10 is an isometric bottom, rear and right side view of the channel defined by the body with the second embodiment of exercise piece on the bottom work surface.

As shown in FIG. 1, body 11 is a peripherally defined "U" shaped member having top 22 with opposing bottom 24 supported at each end by opposed support legs 21 to define curvilinear channel 20 between the legs 21. The top 22 and bottom 24 of body 11 are interconnected by front panel 27 and rear panel 28 which extend downwardly to form the front and back of support legs 21. The inner sides 25 of support legs 21 are formed by depending extensions of the opposed end portions of bottom 24 of body 11. The outer sides 26 of the support legs 21 are formed by elements which extend upwardly to interconnect with top 22 to form the peripherally defined body 11.

The upper surface of top 22 of body 11 defines two similar adjacent rectilinear depressions 29, preferably of square configuration, to carry an inclinable work surface member 13 flush therein. Each inclinable work surface member 13 provides base 51 of rectilinear configuration to fit within depressions 29 of top 22 and has upstanding side elements 51*a* along each side edge that extend upwardly to the upper surface of top element 22 when positioned therein. One side edge 51*a* of the base 51 carries pivoting top element 50 by means of piano hinge 52 extending between one edge of the top element 50 and the upper edge of one upstanding base side element 51*a*. The top element 50 is formed of magnetically permeable material and preferably has depending sides 50*a* to fit inwardly adjacent the upstanding side elements 51*a* and upon the upper surface of base 51 when the pivoting top element 50 is in horizontal position. Support arm 53 is pivotally carried on the under surface of pivoting top element 50 to pivot about an axis parallel to the pivotal axis of the pivoting top element 50 and depend to contact ratchet 54 carried by the upper surface of base 51 to adjustably support the top element 50 in various selectable inclined positions relative to the base 51.

Each work surface member 13 when of square configuration is adjustably positionable in a depression 29 of similar configuration so that pivoting top 50 may be orientated to incline forwardly, rearwardly or in either lateral direction to provide a maximal potential for customizability. The exposed outer surface of the top element 50 may be covered with some friction modifying material such as Teflon® or fabric (not shown) to provide different frictional contact with exercise piece 12.

Bottom 24 of body 11 and its continuations forming inner sides 25 of support legs 21 preferably is also formed of magnetically permeable material to allow body 11 to be turned upside down to provide a second laterally curving exercise surface 24,25. This exercise surface 24,25 may also be covered with friction altering material such as a low friction polymer, a fabric or the like (not shown) to provide greater customizability.

Exercise piece 12 provides a body carrying at least one magnet 30. In a first preferred embodiment shown in FIGS. 4 and 5, the exercise piece 12 is configured as a computer mouse-like structure having upper curvilinear grasping surface 32 and opposed relatively flat bottom surface 33. At least one magnet cavity 35, and in the instance illustrated four such cavities 35, are defined in exercise piece 12 opening to bottom surface 33 and sized to releasably carry magnet 30 therein. As shown in FIG. 5, magnets 30 too small to fastenably engage with circumferential walls defining cavity 35 for positional maintenance may be encased in cavity filler 36 sized or otherwise treated for engagement with the walls of cavities 35 for positional maintenance.

In a second preferred embodiment of exercise piece 12 shown in FIGS. 6 and 7, the exercise piece 12 has body 38,38*a* peripherally formed by supple material such as fiber fabric, polymeric material or the like to define opening 39,39*a* to receive an extremity of a user. Opening 39 may be secured about the user's extremity by closing means such as laces 40 shown in FIG. 6 or opening 39*a* may be closed by cooperating hook and loop fasteners 44 as shown in FIG. 7 carried about the edges of opening 39. Magnet pocket 41 is defined by body 38,38*a* to carry at least one magnet 30 therein as a user moves exercise piece 12 on selected work surface of body 11. The magnet 30 is positionally maintained in magnet pocket 41 by flap 41*a* releasably closable by fasteners 43, in the instance illustrated snaps as heretofore known.

A third embodiment of exercise piece 12 shown in FIG. 8 provides a disk shaped base 42 defining plural magnet cavities 35 shown in phantom outline opening through bottom surface 33. The base 42 is formed of rigid or semi-rigid material such as plastic, wood or the like and magnets (not shown) are positionally maintained in cavities 35 by frictional engagement, adhesive, cavity filler or the like.

Grasping structure 37*a* shown in FIG. 8 comprises an arcuate band fastened at its ends at diametrically opposed portions of the circumferential side of base 42. The grasping structure 37*a* is formed of flexible, semi-flexible or rigid material such as woven fabric banding, leather or semi-rigid plastic to aid a user in maintaining a hand or foot on base 42 and beneath the grasping structure 37*a* for use.

A variant subspecies of the third embodiment of the exercise piece of FIG. 8 is shown in FIG. 9. Here the base 42 remains the same but grasping structure 37*b* is an upstanding cylindrical handle, with or without surface configuration to aid gripping. The grasping structure 37*b* is formed of rigid or semi-rigid material and preferably symmetrically structurally carried in medial portion of the base 42, though it may be asymmetrically positioned if desired. For safety purposes the grasping structure 37*b* should not be any longer axially than necessary and of sufficient diameter to easily grasp, preferably about six inches long and about one inch in diameter.

Having described the structure of my magnetically resistive exercise device its use may be understood.

Body 11 is placed on or over the lap of a seated or semi-supine user such that a desired work surface, either the inclinable work surface members 13 or curvilinear channel 20, is facing upwardly and accessible to user. If one or both inclinable work surface members 13 are to be used, they are positioned in one or both rectilinear depressions 29 defined in top 22 of body 11 so that the direction of inclination of pivoting top element 50 is orientated to accomplish the particular desired exercise. Pivoting support arm 53 carried on the underside of pivoting top element 50 is positioned so that the non-affixed end 53*a* engages with ratchet 54 to establish and positionally maintain inclination of pivoting top element 50 with the desired angulation relative to body 11. One or more magnets 30 are positioned in one or more cavities 35 defined in the lower portion of the exercise piece 12 appropriate for the user and desired exercise.

If the user's physiological limitations prevent effective grasping of the exercise piece 12 of FIGS. 1-2, the exercise pieces of FIGS. 6-9 may provide greater use potential. For such use magnets as appropriate for the desired exercise are placed in the exercise piece 12 chosen and the user extremity selected for exercise is placed through opening 39 of body 38 with either species of FIG. 6 or 7 body 38*a* or 38*b* is secured about user extremity by laces 40 or hook and loop fastener 44 adjacent openings 39.

For use exercise piece 12 is placed on the selected work surface and is moved by the user on that surface. Attraction of magnets 30 to material of the magnetically permeable work surface generates uniform continuous resistance to movement of exercise piece 12 on the surface of the body 11, in any direction the exercise piece 12 is moved. This resistance may be widely varied to allow substantial customization to match the needs of users as hereinbefore indicated. Exercise pieces 12 of FIGS. 4-9 may be similarly prepared and used when the nature of their grasping structures may be more appropriate for a user.

Having thusly described my invention, what I desire to protect by Letters Patent, and

What I claim is:

1. A magnetically resistive exercise device for rehabilitative therapy comprising in combination:

a body having at least one work surface of magnetically permeable material, the body being elongate and peripherally defined with a top surface and opposed depending support legs at each elongate end to define a curvilinear channel between the support legs, forming a bottom curvilinear work surface, said top surface defining at least one rectilinear depression therein releasably carrying an inclinable work surface member having a base and pivotable top interconnected by hinge at one side of the base, said pivoting top formed of magnetically permeable material to define a work surface and supported for adjustable angulation by a support arm pivotally carried by the pivoting top to depend therefrom for support on a ratchet carried on the adjacent surface of the base; and an exercise piece movable on the at least one work surface and carrying at least one magnet to generate frictional resistance to movement of the exercise piece on the at least one magnetically permeable work surface of the body.

2. The magnetically resistive exercise device of claim 1 wherein:

the exercise piece has a continuously curvilinear top surface configured to aid manual grasping by the palm of a user's hand and an opposing lower supportative surface, said exercise piece defining at least one cavity communicating through the lower supportative surface to carry and positionally maintain the at least one magnet therein.

3. The magnetically resistive exercise device of claim 1 wherein:

the exercise piece has a body peripherally formed of supple material to define a chamber to receive an appendage of a user therein with at least one opening releasably closable about the appendage of the user to aid in maintaining the appendage of the user in the chamber;

at least one releasably closable magnet pocket to carry at least one magnet; and means for releasably closing the magnet pocket to positionally maintain the at least one magnet in the magnet pocket.

4. The magnetically resistive exercise device of claim 1 wherein:

the exercise piece comprises a disk with opposed surfaces having an arcuate band extending thereover and fastened thereto at generally diametrically opposed side portions, said exercise piece defining at least one cavity communicating through the surface distal from the arcuate band to carry and positionally maintain the at least one magnet therein.

5. The magnetically resistive exercise device of claim 1 wherein:

the exercise piece comprises a disk with opposed surfaces having an upstanding handle carried on an upper medial portion of the upper surface, said exercise piece defining at least one cavity communicating through the lower surface to carry and positionally maintain the at least one magnet therein.

* * * * *